United States Patent [19]

Pendlebury et al.

[11] 3,999,910

[45] Dec. 28, 1976

[54] FILAMENT QUENCHING APPARATUS

[75] Inventors: David Pendlebury, Chester, Va.; James Edwin Bradshaw, Chapel Hill, N.C.

[73] Assignee: Allied Chemical Corporation, Morris Township, N.J.

[22] Filed: Oct. 8, 1975

[21] Appl. No.: 620,521

[52] U.S. Cl. ..... 425/72 S; 264/176 F

[51] Int. Cl.[2] ..... D01D 5/08

[58] Field of Search ..... 425/72 S; 264/176 F

[56] References Cited

UNITED STATES PATENTS

| | | | |
|---|---|---|---|
| 3,320,343 | 5/1967 | Buschmann et al. | 264/176 F |
| 3,834,847 | 9/1974 | Fletcher | 425/72 S |

*Primary Examiner*—Robert D. Baldwin
*Attorney, Agent, or Firm*—Patrick L. Henry

[57] ABSTRACT

An apparatus for producing a substantially nonturbulent stream of cooling gas for quenching a melt extruded filament, said apparatus comprising a new gas plenum chamber wherein gas diverting means turns and directs the cooling gas through the plenum chamber for passage through a diffuser, simultaneously reducing turbulence and smoothing the velocity profile of the cooling gas for passage through the diffuser. Another feature of the apparatus is its ability to supply different gas rates to the upper and lower zones of the quench cabinet.

20 Claims, 4 Drawing Figures

FILAMENT QUENCHING APPARATUS

BACKGROUND OF THE INVENTION

This invention relates to an apparatus for the production of a substantially nonturbulent stream of cooling gas for quenching one or more synthetic filaments produced by a melt spinning process.

In a typical melt spinning process, one or more filaments is extruded from one or more spinnerettes and passed into a quenching chamber. The quenching chamber comprises one or more walls, one of which is a diffuser separating the quenching chamber from an adjoining plenum chamber which is in communication with a cooling gas supply system. The synthetic polymer extruding from the spinnerette is a viscous liquid at an elevated temperature. Cooling of this liquid takes place in the quenching chamber where a cooling gas, which is usually air, is contacted with the filaments. The cooling gas enters the quenching chamber from the plenum chamber through the diffuser in a direction substantially perpendicular to the filaments. The filaments pass through the quenching chamber in a direction substantially parallel to the diffuser separating the plenum chamber from the quenching chamber. The use of the diffuser is necessary to reduce cooling gas turbulence; filaments are highly vulnerable to cooling gas turbulence since they are in the liquid phase at entry into the quenching chamber. Turbulence in the cooling gas stream detracts from the uniformity of the filaments.

Today, the demand is for higher yields at higher throughput rates while maintaining, preferably improving, yarn properties. One method of obtaining greater capacity is to increase the number of spinnerette extrusion orifices, resulting in a corresponding increase in the number of extruded filaments. Existing space limitations often dictate the maximum spinnerette plate size, and an increase in the number of extrusion orifices therethrough results in decreased extrusion orifice spacing. Faster yarn speeds coupled with decreased distances between spun filaments, causes undesirable crowding of the filaments, frequently with interfilament collisions, in the quenching zone. As a consequence, improving the stability of the threadline and improving yarn uniformity are very important. To realize these objectives, there must be better control of the quench gas flow rate and more uniform distribution of cooling gas across the diffuser and within the quench cabinet.

The diffuser has been the primary means of reducing turbulence in the cooling gas stream. There are a variety of diffusers in the prior art; these include screens, porous foam, perforated metal plates, sintered metal, metallic wool, and sandwiches of mesh screens, to name a few. The design of the diffuser is critical as it determines the velocity profile of the cooling gas in the quenching chamber. In quench cabinets designed such that the cooling gas is supplied to the diffuser other than laterally thereto, the incoming gas must be turned through an angle in the plenum chamber so as to pass through the diffuser into the quenching chamber. For example, a typical cross flow quench cabinet with the gas intake at the rear of its base must turn the incoming gas through a right angle so that it can pass laterally through the diffuser. This is critical because the design of the gas intake plenum chamber determines the velocity distribution of gas supply to the diffuser pack which, as mentioned previously, determines the velocity profile of the cooling gas in the quenching chamber. Turning vanes of the inclined ladder type have been used in the plenum chamber to turn the cooling gas through this angle. However, the incoming gas tends to be deflected at an angle similar to the angle of incidence, resulting in a higher velocity region over the lower portion of the plenum chamber between the turning vane and the diffuser. As a consequence, the gas flow supplied to the diffuser is very uneven, and the diffuser must be extremely efficient to smooth out the velocity profile of the cooling gas for contact with the melt extruded filaments. Without the turning vane, cooling gas is randomly distributed in the plenum chamber and again, the velocity profile of gas supply to the diffuser pack is uneven.

In conventional quenching chambers having substantially cross flow of the cooling gas therethrough, the cooling rate decreases as the filaments descend through the quenching chamber. It is therefore desirable to have a quench system which is flexible enough to allow different cooling gas rates to be supplied to varying sections of the quenching chamber. FIGS. 2 and 3 of U.S. Pat. No. 2,273,105 depict a quench system having a plurality of sections, to each of which a cooling medium is separately supplied and which are separated by partitioning means. The velocities of the cooling mediums being supplied to these sections can be varied independently. The chief disadvantage of this patented apparatus stems from the straight-line jetting action of the air on entering the plenum chamber, which jetting action tends to cause uneven velocity distribution of the air downstream of the diffuser. U.S. Pat. No. 3,274,644 provides a quenching chamber comprising essentially vertical inlet and outlet panels for allowing a gaseous cooling medium to pass through the chamber, and means for passing the extruded filaments vertically downwards through the chamber. Each of the inlet and outlet panels comprises a plurality of adjacent, horizontally disposed sections, and each of the sections contains means for individually regulating the stream of the gaseous cooling medium passing through the section. Unfortunately, regulating the apparatus of this patent is relatively difficult and unduly complicated for commercial operation.

The apparatus of the present invention essentially eliminates all of the aforementioned problems and yields yarns of high quality at high rates. The internal parts are designed so as to allow different gas rates to be supplied to the upper and lower zones of the quench cabinet with, simultaneously, turbulence being reduced and the velocity profile of the cooling gas at the upstream face of the diffuser being smoothed for passage therethrough.

SUMMARY OF THE INVENTION

In accordance with the present invention, there is provided an apparatus for producing a substantially nonturbulent stream of cooling gas for quenching a melt extruded filament. The essential elements are a quenching chamber, a plenum chamber, and gas supply means. The melt extruded filament passes through the quenching chamber, which is separated from the plenum chamber by a diffuser. The plenum chamber comprises a gas entry opening and gas diverting means. The gas entry opening is located such that cooling gas entering therethrough must effect a turn in the plenum chamber to pass through the diffuser. The gas diverting means is located between the diffuser and the gas entry opening, and comprises a plate, a honeycomb sheet, and means for sandwiching together the plate and honeycomb sheet. The plate has a plurality of perforated sections which are separated by imperforate sections. The honeycomb sheet is mounted on the face of the plate which is closer to the diffuser. The gas supply means delivers the cooling gas to the gas entry opening. The cooling gas effects the turn in the plenum chamber and is directed for passage through the diffuser via the gas diverting means. The gas diverting means also functions to reduce turbulence and to smooth the velocity profile of the cooling gas for passage through the diffuser.

In a preferred embodiment of the present invention, a new gas plenum chamber has been designed which gives a more uniform flow of cooling gas to the diffuser and which allows different gas rates to be supplied to the upper and lower zones of the quench cabinet. The essential elements are a quenching chamber, a plenum chamber, and gas supply means. The melt extruded filament passes substantially vertically through the quenching chamber, which is separated from the plenum chamber by a diffuser substantially vertically there-between and approximately parallel to the melt extruded filament. The plenum chamber comprises a gas entry opening located at the base thereof, a first perforated plate, gas diverting means, first baffle means, second baffle means, and a gas rate adjuster. The first perforated plate is spaced from and disposed approximately parallel to the diffuser, between the diffuser and the gas entry opening. The gas diverting means, which is located between the first perforated plate and the gas entry opening, is inclined from the vertical to form a diagonal whose ends terminate at the upstream base of the first perforated plate and the intersection of the back wall and the ceiling of the plenum chamber. The sides of the gas diverting means along its length are in contact with the side walls of the plenum chamber. The gas diverting means comprises a second perforated plate, a plurality of blocking strips, a plurality of spacing means, two angle irons, a honeycomb sheet, and means for sandwiching these elements together. The open area of the second perforated plate ranges from 10 to 40 percent. The blocking strips are spaced on the face of the second perforated plate and have a length corresponding approximately to the width of the second perforated plate. The blocking strips cover approximately 30 to 40 percent of the face so as to decrease the open area of the second perforated plate to between 6 and 28 percent. The spacing means are interposed between each of the blocking strips on the lengthwise edges of the face of the second perforated plate so as to fixedly space the blocking strips relative to one another. Each of the two angle irons has a length approximately equal to the length of the second perforated plate and is mounted, above the area corresponding to one of the lengthwise edges, on the downstream face of the second perforated plate. One of the legs of each of the angles projects approximately perpendicularly downstream from the second perforated plate. The honeycomb sheet is placed in the tray formed by the angle irons and the second perforated plate. The cells of the honeycomb sheet are disposed in a horizontal plane which is approximately perpendicular to the plane of the first perforated plate. The first baffle means extends in a horizontal plane from the upstream face of the diffuser to the second perforated plate of the gas diverting means. The first baffle means is positioned such that the length of the gas diverting means therebelow varies from being approximately equal to the length of the gas diverting means thereabove to being approximately four times the length of the gas diverting means thereabove. Also, the first baffle means is positioned such that if extended in the horizontal plane, it would intersect the melt extruded filament just below the fiber stick point. The first baffle means has its sides in contact with the side walls of the plenum chamber. The second baffle means extends downwardly in a vertical plane from the first baffle means at the second perforated plate so as to form approximately a right angle with the first baffle means. The second baffle means, the sides of which are in contact with the side walls of the plenum chamber, functions in conjunction with the first baffle means to divide the plenum chamber into two separate zones. The gas rate adjuster comprises a plate and adjusting means. The plate, the plane of which approximately coincides with the plane of the second baffle means, is pivotally connected along the length of its upper end to the lower end of the second baffle means along its respective length. The plate pivots in a planar arc, the ends of which are defined by the back wall of the plenum chamber in one direction and by the gas diverting means of the plenum chamber in the other direction. The length of the plate is such that the plate completely shuts off one of the zones when pivoted as far as possible in either direction. The length of the second baffle means is fixed by the length of the plate. The adjusting means is connected at one end to the plate and passes through the back wall of the plenum chamber at its other end. The movement of the adjusting means causes a corresponding movement of the plate in its planar arc. The gas supply means delivers the cooling gas to the plenum chamber at the base thereof, between the back wall of the plenum chamber and the lower end of the gas diverting means. A honeycomb sheet is disposed horizontally across the gas supply means just prior to the gas entry opening at the base of the plenum chamber. The gas rate adjuster in conjunction with the first and second baffle means permits variation of the flow rate of the cooling gas for quenching of the melt extruded filament approximately above and below the fiber stick point. The gas diverting means turns and directs the cooling gas for passage through the diffuser, and simultaneously reduces turbulence and smooths the velocity profile of the cooling gas for passage through the diffuser. Preferably, a valve is disposed across the gas supply means upstream of the honeycomb sheet. This valve functions in conjunction with the gas rate adjuster to permit the independent variation of the flow rate of the cooling gas with respect to each of the zones of the plenum chamber defined by the first and second baffle means. It is also desirable that the diffuser be a porous, multicellular, polymeric foam.

DETAILED DESCRIPTION OF THE DRAWINGS

Figure 1A:
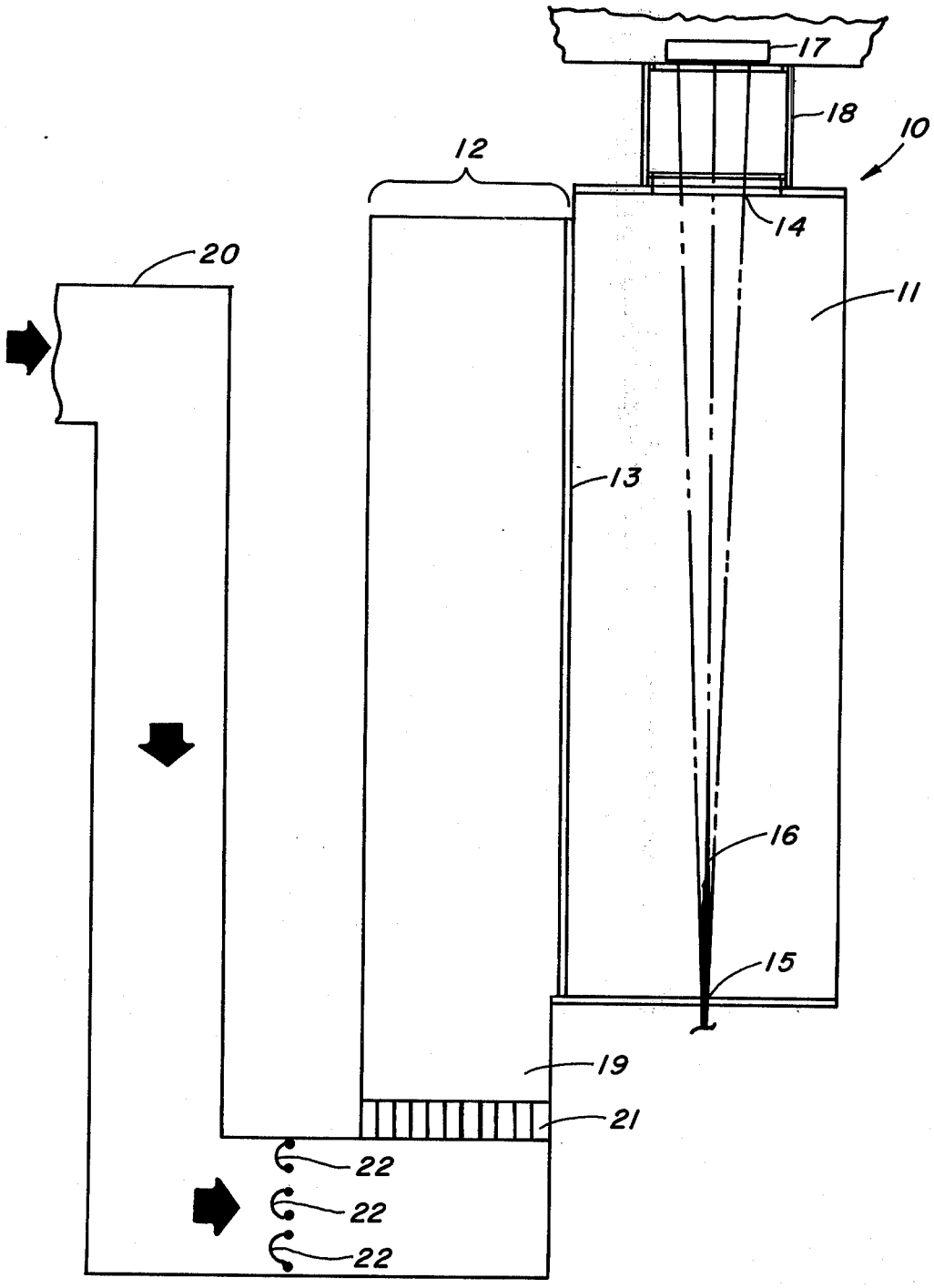
FIG. 1A PRIOR ART
FIG. 1A is a side elevational section of a conventional quench system.

In the accompanying drawings, like numbers indicate like apparatus. With reference to FIG. 1A, which depicts a conventional quench system, numeral 10 designates an elongated chimney which is substantially rectangular in cross-section. Quenching chamber 11 is separated from plenum chamber 12 by diffuser 13 substantially vertically therebetween, and has an inlet 14 and an outlet 15 for passage of filament bundle 16 substantially vertically therethrough and approximately parallel to diffuser 13. Filament bundle 16 is extruded from spinnerette plate 17, passes through heated sleeve 18 into quenching chamber 11, exits therefrom either for collection on some takeup means (not shown) or for further process treatment. To the rear of elongated chimney 10, in the floor of plenum chamber 12, is located gas entry opening 19 to which gas supply means 20 delivers the gaseous cooling medium. Gas supply means 20 may be in the form of a conduit, as shown in the drawings, and has a honeycomb sheet 21 disposed horizontally thereacross just prior to gas entry opening 19. The cells of honeycomb sheet 21 are disposed in a vertical plane and direct the gaseous cooling medium into plenum chamber 12. A valve 22 is disposed across gas supply means 20 upstream of honeycomb sheet 21 for control of the total gas flow rate. Cooling gas enters plenum chamber 12 via gas supply means 20 and then passes through diffuser 13 into quenching chamber 11 in order to quench filament bundle 16. The cooling gas, in effecting the 90° turn through plenum chamber 12, has an uneven velocity profile upstream of diffuser 13. Unless diffuser 13 is extremely efficient, the velocity profile of the cooling gas on its downstream side will also be uneven.

Figure 1B:
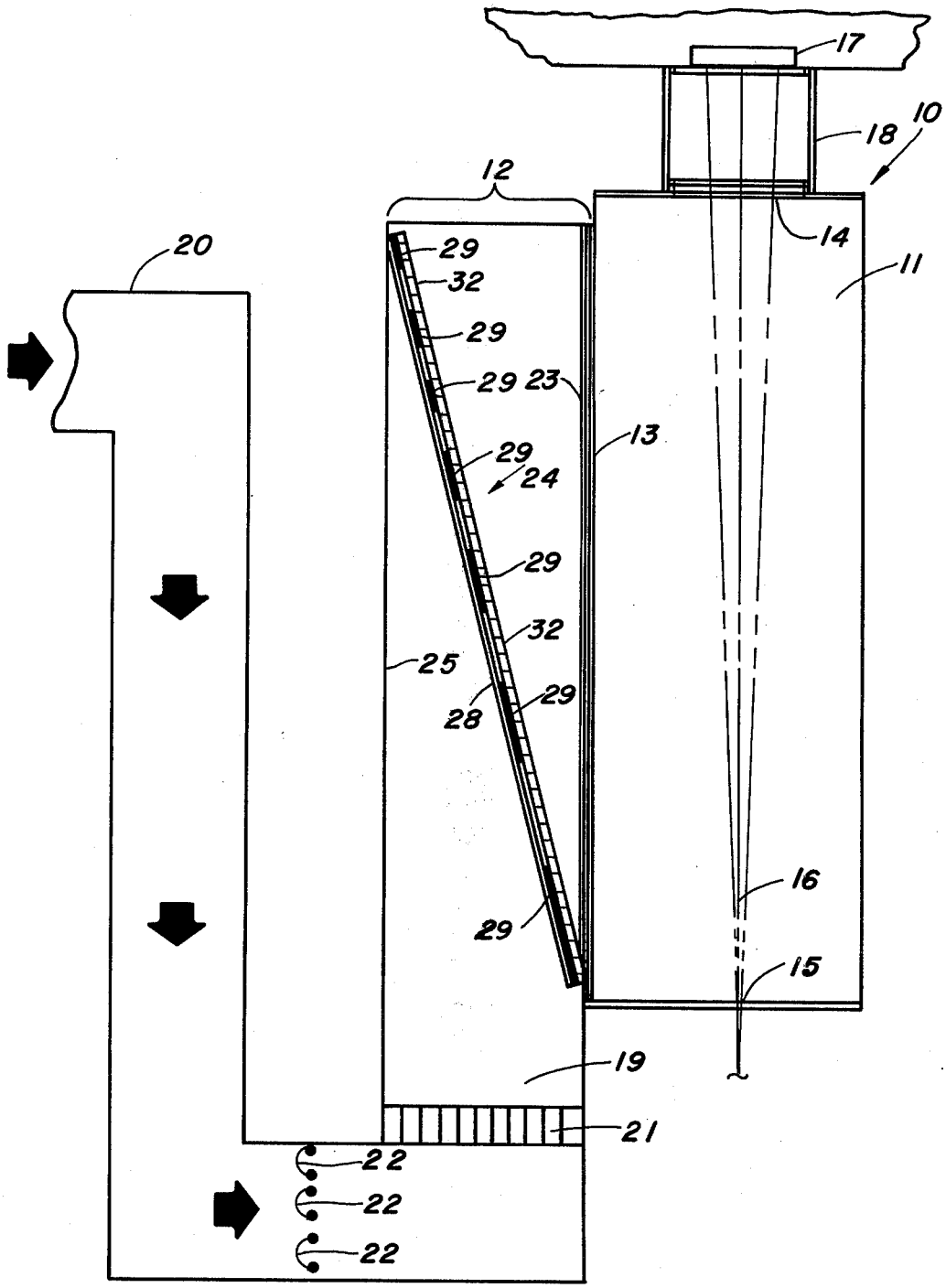
FIG. 1B is a side elevational section which incorporates FIG. 1A and the gas diverting means of the present invention.
Figure 2:
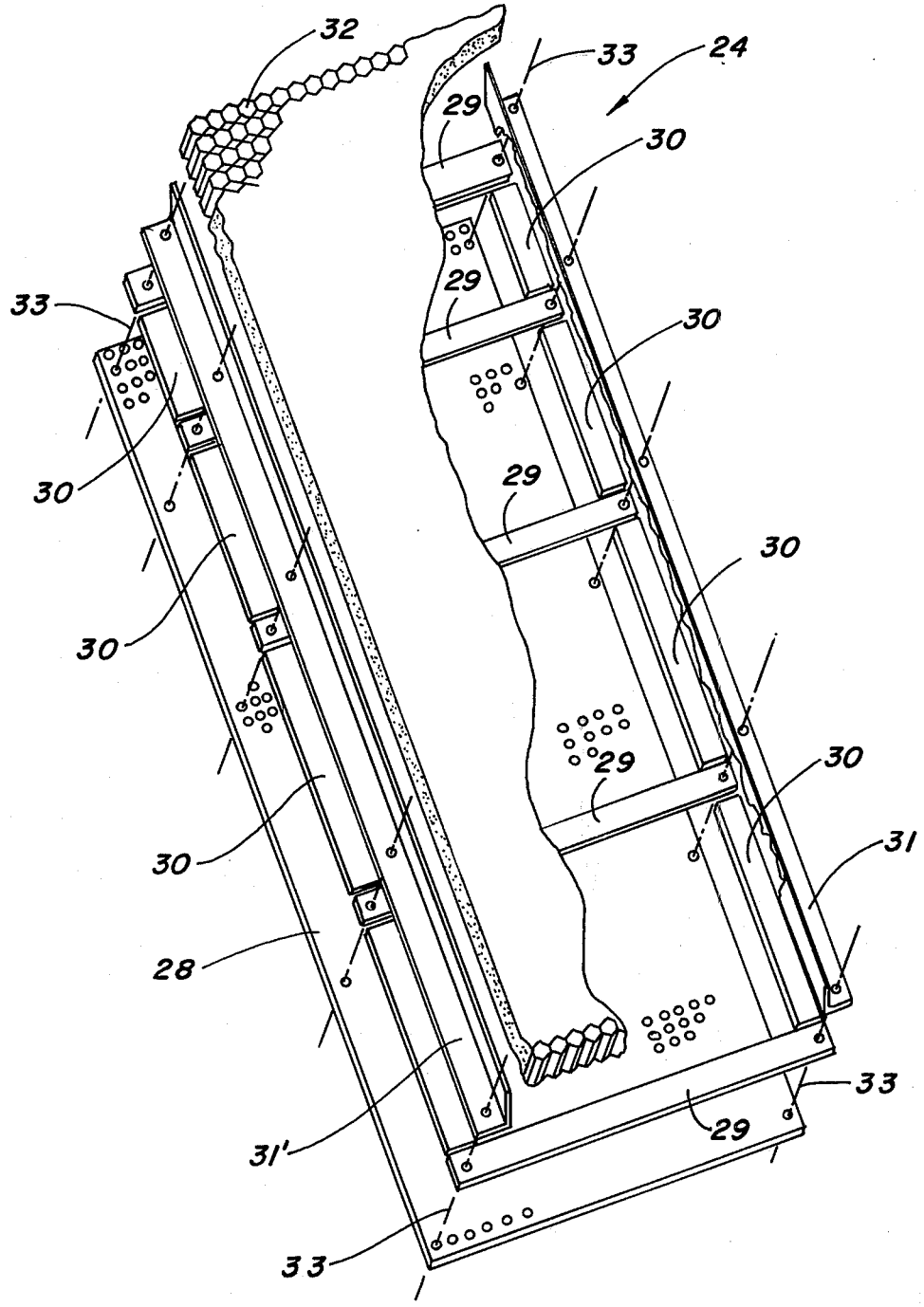
FIG. 2 is a detail of assembly technique of the gas diverting means.

With reference to FIGS. 1B and 2, turbulence is reduced and the velocity profile of the cooling gas at the upstream face of diffuser 13 is smoothed by the following improvements. A first sheet of perforated plate 23 is spaced from and disposed approximately parallel to diffuser 13 between diffuser 13 and gas entry opening 19. First perforated plate 23 is spaced from 1/16 to 6 inches from diffuser 13, and more preferably from ½ to 2 inches therefrom, and has an open area of between 2 and 50 percent. First perforated plate 23 breaks up some of the turbulence in plenum chamber 12 and meters the cooling gas directly onto diffuser 13. It should not be located after diffuser 13 as the jetting action of the cooling gas through the perforations would persist for several inches into quenching chamber 11 and have an adverse affect on filament bundle 16. Sufficient pressure exists in the gap between first perforated plate 23 and diffuser 13 to drive the cooling gas through diffuser 13, and this buffer chamber effect causes a lateral redistribution of the cooling gas. Diffuser 13 will dampen down remaining eddies and cause local redistribution of the cooling gas. Gas diverting means 24 is located between first perforated plate 23 and gas entry opening 19, and is inclined from the vertical to form a diagonal whose ends terminate at the upstream base of first perforated plate 23 and at the back wall 25 of plenum chamber 12. It is preferred that the end terminating at back wall 25 terminate in the upper 50 percent thereof. The sides of gas diverting means 24 along its length are in contact with the side walls of plenum chamber 12. Gas diverting means 24 comprises a second perforated plate 28, a plurality of blocking strips 29, a plurality of spacing means 30, two angle irons 31 and 31', a honeycomb sheet 32, and means 33 for sandwiching these elements together. Second perforated plate 28 has an open area ranging from 10 to 40 percent. By "open area" is meant that area through which the cooling gas can pass. Second perforated plate 28 reduces the ratio of maximum to minimum velocities of the cooling gas prior to first perforated plate 23 and diffuser 13. A plurality of blocking strips 29 are spaced on second perforated plate 28. Although either the upstream or downstream face of first perforated plate 28 can be utilized, the drawings show blocking strips 29 on the downstream face thereof. Blocking strips 29 are horizontally positioned, rectangular strips which serve to block the flow of cooling gas through some of the perforations in second perforated plate 28, to thereby improve the velocity profile. Their number and spacing will be more fully explained hereafter. Blocking strips 29 are fixedly spaced by spacing means 30, which may be rubber strips for example. It is possible to rivet or glue blocking strips 29 to second perforated plate 28, but this would eliminate the flexibility of the system. Spacing means 30 and blocking strips 29 can be easily shifted according to the desired gas distribution. It should also be noted that second perforated plate 28 could be manufactured to specification with alternate perforate and imperforate sections; however, this is more expensive and less flexible than utilizing the system as herein described. Also, the difference in efficiency is too slight to warrant the difference in expense. Spacing means 30 do not traverse the horizontal width of second perforated plate 28, but rather are only as wide as necessary to fixedly space blocking strips 29. Next downstream of blocking strips 29 are two angle irons 31 and 31'. They have a length approximately equal to the length of second perforated plate 28 and are mounted above the areas corresponding to the lengthwise edges on the downstream face thereof. One of the legs of each of angle irons 31 and 31' projects approximately perpendicularly downstream from second perforated plate 28. In the tray formed by angle irons 31 and 31' and second perforated plate 28 is placed a honeycomb sheet 32. The cells of honeycomb sheet 32 can be perpendicular to the plane of second perforated plate 28 or canted therefrom. It is preferred that they be canted to the horizontal plane approximately perpendicular to the plane of first perforated plate 23. Means 33 are provided for sandwiching these elements together to prevent leakage or bowing, and may comprise a plurality of bolts or any other suitable means. Second perforated plate 28 provides support for honeycomb sheet 32 and in combination therewith serves to turn the gaseous cooling medium through the 90° angle with a minumum of turbulence. Honeycomb sheet 32 directs the flow of the cooling gas to first perforated plate 23 and diffuser 13.

Figure 1C:
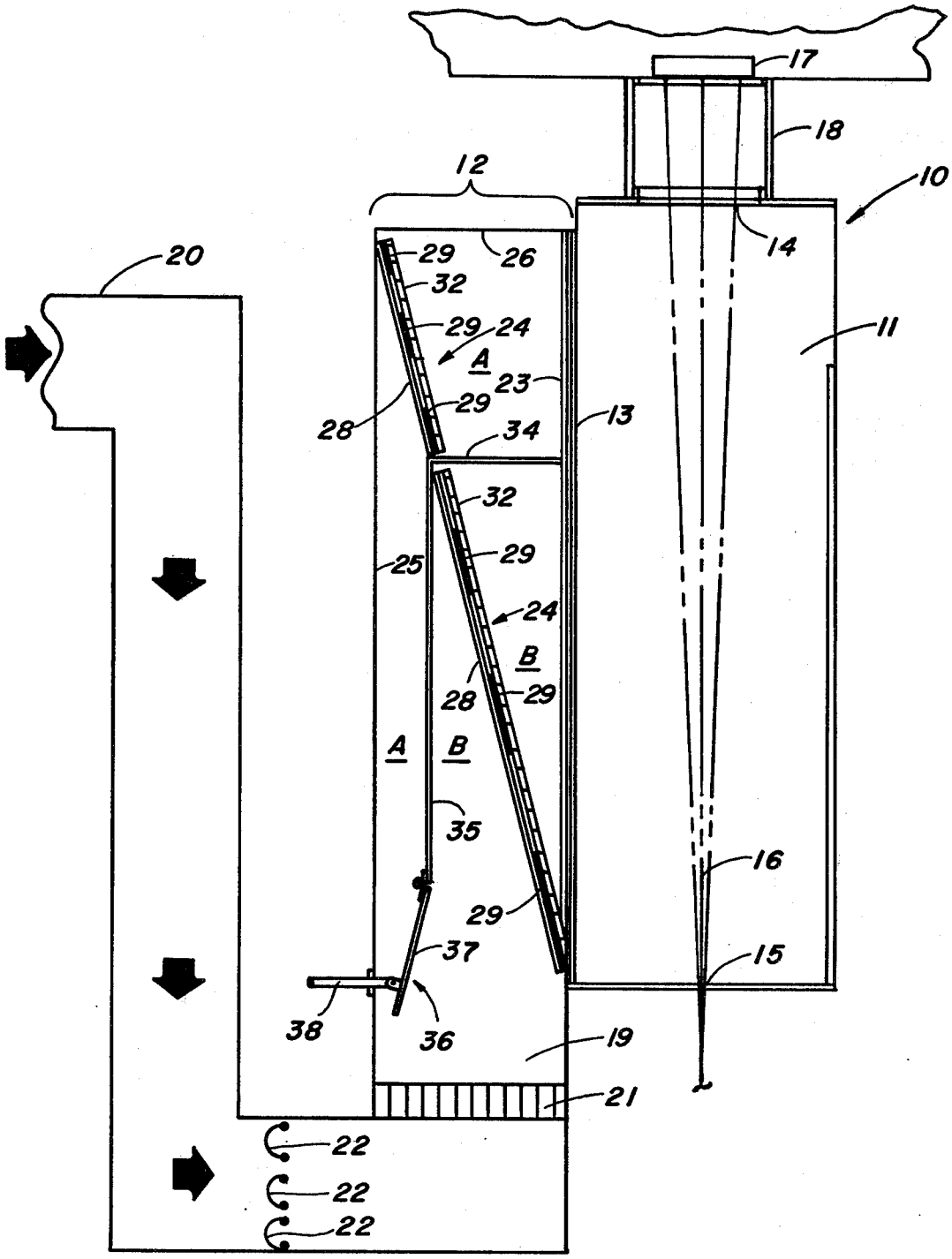
FIG. 1C is a side elevational section which incorporates FIGS. 1A, 1B and the zone dividing means of the present invention.

FIG. 1C is a composite of FIGS. 1A and 1B, and shows in addition thereto apparatus for supplying different cooling gas rates to the upper and lower zones of quenching chamber 11. First baffle means 34 extends in a horizontal plane from the upstream face of diffuser 13 to second perforated plate 28 of gas diverting means 24. First baffle means 34 would, in the most preferred embodiment, intersect filament bundle 16 just below the fiber stick point, if extended in its horizontal plane. The fiber stick point is a dividing line in the threadpath, downstream of which filaments will not stick or adhere to a smooth surfaced rod, such as glass or metal, which is placed within the filament bundle, and upstream of which the filaments will stick or adhere thereto. First baffle means 34 divides gas diverting means 24 at its point of intersection therewith into two lengths. The length of gas diverting means 24 below first baffle means 34 can vary from being approximately equal to its length above first baffle means 34 to being four times its length above first baffle means 34. The sides of first baffle means 34 are in contact with the side walls of plenum chamber 12. First baffle means 34 can be a continuous imperforate plate, in which instance first perforated plate 23 and gas diverting means 24 are separated thereby into two parts, respectively, or first baffle means 34 can comprise two plates, one of which is fixed at the downstream face of first perforated plate 23 and extends to diffuser 13 and the other of which is fixed at the upstream face of first perforated plate 23 and extends to second perforated plate 28 of gas diverting means 24. Second baffle means 35 extends downwardly in a vertical plane from first baffle means 34 at second perforated plate 28 so as to form approximately a right angle therewith. Second baffle means 35 also has its sides in contact with the side walls of plenum chamber 12, and functions in conjunction with first baffle means 34 to divide plenum chamber 12 into two separate zones, indicated in the drawings by the letters A and B. Gas rate adjuster 36 comprises a plate 37 and adjusting means. The plane of plate 37 approximately coincides with the plane of second baffle means 35, and plate 37 is pivotally connected along the length of its upper end to the lower end of second baffle means 35 along its respective length. Plate 37 pivots in a planar arc, the ends of which are defined by back wall 25 of plenum chamber 12 in one direction and by gas diverting means 24 of plenum chamber 12 in the other direction. The length of plate 37 is such that plate 37 can completely shut off either zone A, when pivoted until it contacts back wall 25, or zone B, when pivoted until it contacts gas diverting means 24. That portion of plate 37 which contacts back wall 25 when plate 37 is pivoted to shut off zone A is preferably beveled so as to come into fluid tight contact therewith. The length of second baffel means 35 is fixed by the length of plate 37, i.e., plate 37 should be long enough to completely shut off either of zones A and B. The adjusting means, as depicted in the drawings, may comprise for example a slotted arm 38 which is hinged at one end to plate 37 and which passes through back wall 25 of plenum chamber 12 at its other end. Arm 38 is long enough to extend through back wall 25 when plate 37 is pivoted to shut off zone B. Movement of arm 38 causes a corresponding movement of plate 37, and means are provided for securing arm 38 so as to fix plate 37 at any desired position within its planar arc of movement. Sealing means (not shown) are also provided to ensure that back wall 25 is air tight where arm 38 passes therethrough. A window may be provided at the base of the side wall of plenum chamber 12 so that the position of plate 37 can be easily ascertained. It is possible for adjusting means to be provided which pass through the side walls, and the window could alternately be placed at the base of back wall 25. If desired, two adjustable plates could be utilized for independent control of gas flow to zones A and B. However, adjustment of plate 37 as described herein in conjunction with adjustment of valve 22 suffices to permit independent control of gas flow to zones A and B. Gas rate adjuster 36 in conjunction with first 34 and second 35 baffle means permits variation of the flow rate of the gaseous cooling medium for quenching of filament bundle 16 approximately above and below the fiber stick point. The gas diverting means 24 turns and directs the cooling gas for passage through diffuser 13, simultaneously functioning to reduce turbulence and to smooth the velocity profile of the cooling gas for passage through diffuser 13.

Without blocking strips 29, the gas flow through the apparatus described herein tended to show a higher velocity due to the momentum of the incoming gas through the upper portions of second perforated plate 28 in each of the two zones A and B. To eliminate this problem, the blocking strips 29 are positioned so as to progressively decrease the open area of the upper positions of said second perforated plate 28 in each of the two zones A and B. The blocking strips 29 preferably cover approximately 30 to 40 percent of the face of second perforated plate 28 so as to decrease the open area thereof to between 6 and 28 percent. These figures apply to each of zones A and B, respectively.

EXAMPLE 1

Cooling gas was supplied to the apparatus of the present invention (see FIGS. 1C and 2), and a velocity profile was measured 2½ inches downstream of diffuser 13. Quenching chamber 11 was approximately 67 inches in length, and first baffle means 34 between zones A and B was set at approximately 1½ feet from the ceiling 26 of plenum chamber 12. Location of first baffle means 34 was based on the fact that the fiber stick point is approximately 10 to 15 inches below the ceiling 26 of plenum chamber 12. Multiple zones were unnecessary in the lower half of zone B as relatively little quenching takes place in the corresponding portion of quenching chamber 11, probably due to the high yarn velocity and close spacing between filaments in that area. Plate 37 of gas rate adjuster 36 was positioned so that the total gas velocity through each of zones A and B was approximately identical. Diffuser 13 was a porous, multicellular, polymeric foam such as that described in U.S. Pat. No. 3,619,452, assigned to Allied Chemical Corporation. A diffuser of this material is inexpensive and easy to handle. It is also lighter and more flexible than other prior art diffusers. The length of gas diverting means 24 below first baffle means 34 was approximately three times its length thereabove, i.e., 48 inches in zone B and 16 inches in zone A. The cells of honeycomb sheet 32 were approximately perpendicular to second perforated plate 28. Blocking strips 29 were placed on the downstream face of second perforated plate 28. In zone A, four blocking strips 29 were placed as follows: strip 1 with a width of 2¼ inches was placed at the top of second perforated plate 28; strip 2 with a width of 1 inch was placed approximately 2½ inches below strip 1; strip 3 with a width of 1¾ inches was placed approximately 2¾ inches below strip 2; strip 4 with a width of 1 inch was placed approximately 3¼ inches below strip 3; and a space of approximately 1½ inches was left between strip 4 and first baffle means 34. In zone B, nine blocking strips 29 were placed as follows: strip 1 with a width of 2 inches was placed on second perforated plate 28 just below first baffle means 34; strip 2 with a width of 1¾ inches was placed approximately 1¾ inches below strip 1; strip 3 with a width of 1¾ inches was placed approximately 1¾ inches below strip 2; strip 4 with a width of 1¾ inches was placed approximately 2 inches below strip 3; strip 5 with a width of 1½ inches was placed approximately 2¼ inches below strip 4; strip 6 with a width of 2 inches was placed approximately 2½ inches below strip 5; strip 7 with a width of 1½ inches was placed approximately 3 inches below strip 6; strip 8 with a width of 1½ inches was placed approximately 4½ inches below strip 7; strip 9 with a width of 1 inch was placed approximately 5 inches below strip 8; and a space of approximately 10¾ inches was left after strip 9. Gas flow in feet per minute was measured 2½ inches downstream of diffuser 13 using a conventional hot wire anemometer. Gas flow measurements were made at 50–70 points approximately evenly spaced over the diffuser surface to obtain a gas velocity profile, and a statistical analysis of the data was made. The results are shown in Table I.

EXAMPLE 2 (Comparative)

Cooling gas was supplied to the apparatus in FIG. 1A (conventional quench system), and a velocity profile was measured 2½ inches downstream of diffuser 13 as in Example 1. Quenching chamber 11 was approximately 67 inches in length, and a diffuser 13 as described in Example 1 was used. Conventional turning vanes were put in plenum chamber 12 in place of gas diverting means 24 of the present invention. The results obtained are shown in Table 2.

A comparison of the data in Tables 1 and 2 shows that the coefficient of variation of the gas flow was reduced by using the apparatus of the present invention to less than 3% versus the greater than 7% obtained by using conventional quenching apparatus. As a consequence, the velocity profile of the cooling gas upstream of diffuser 13 has been smoothed and turbulence reduced by using the apparatus of the present invention.

The cooling gas which is used in the present invention can be any inert gas, for example, carbon dioxide, nitrogen, and the like but is preferably air at about room temperature supplied at from 40 to 100 FPM (feet per minute).

Example 1 above illustrates said preferred apparatus of the present invention and is not to be considered limiting of the invention in any manner. Various modifications and other advantages will be apparent to one skilled in the art, and it is intended that this invention be limited only as set forth in the following claims.

What is claimed is:

1. An apparatus for quenching a melt extruded filament which comprises:

A. a quenching chamber adapted to have said melt extruded filament pass therethrough;

B. a plenum chamber, said plenum chamber being separated from said quenching chamber by a diffuser and comprising:

B-1. a gas entry opening;

B-2. gas diverting means, said gas diverting means being located between said diffuser and said gas entry opening;

B-3. first baffle means, said first baffle means extending in a plane from said diffuser to said gas diverting means;

B-4. second baffle means, said second baffle means extending in a plane from the intersection of said first baffle means and said gas diverting means towards said gas entry opening, said second baffle means functioning in conjunction with said first baffle means to divide said plenum chamber into at least two separate zones; and B-5. gas rate adjusting means, said gas rate adjusting means being arranged with respect to said first and said second baffle means so as to regulate the amount of cooling gas being supplied to each of said zones; and C. gas supply means, said gas supply means delivering said cooling gas to said gas entry opening;

whereby said cooling gas is directed for passage through said diffuser via said gas diverting means, and said gas rate adjusting means regulates the amount of said cooling gas being supplied to each of said zones.

2. The apparatus of claim 1 wherein said gas diverting means comprises a perforated plate, a honeycomb sheet, and means for sandwiching together said perforated plate and said honeycomb sheet, said honeycomb sheet being mounted on the face of said perforated plate which is closer to said diffuser.

3. The apparatus of claim 1 wherein said gas rate adjusting means comprises at least one plate and adjusting means, the plane of said plate approximately coinciding with the plane of said second baffle means, said plate being pivotally connected along the length of one of its ends to the end of said second baffle means closer to said gas entry opening along its respective length, said plate pivoting in a planar arc and having a

TABLE I

| Quench Unit | Mean Gas Flow, (FPM) | Gas Flow Standard Deviation (FPM) | Gas Flow Range (FPM) | Gas Flow Coefficient of Variation (%) | Gas Flow, No. of Measurements |
|---|---|---|---|---|---|
| No. 1 | 65.1 | 1.3 | 5 | 2.0 | 69 |
| No. 2 | 64.6 | 1.8 | 7 | 2.8 | 69 |
| No. 3 | 61.1 | 1.5 | 5 | 2.5 | 51 |
| No. 4 | 61.2 | 1.3 | 5 | 2.1 | 51 |

TABLE II

| Quench Unit | Mean Gas Flow, (FPM) | Gas Flow Standard Deviation (FPM) | Gas Flow Range (FPM) | Gas Flow Coefficient of Variation (%) | Gas Flow, No. of Measurements |
|---|---|---|---|---|---|
| No. 5 | 64.6 | 4.6 | 22 | 7.1 | 69 |
| No. 6 | 66.4 | 6.1 | 29 | 9.2 | 69 |
| No. 7 | 59.5 | 4.9 | 26 | 8.3 | 69 |

length such that said plate is capable of completely shutting off one of said zones when pivoted in either direction, the length of said second baffle means being fixed by the length of said plate, said adjusting means being connected at one end to said plate and passing through said plenum chamber at its other end, movement of said adjusting means causing a corresponding movement of said plate in said planar arc.

4. The apparatus of claim 3 wherein the number of said plates is two, and the flow rate of said cooling gas with respect to each of said zones of said plenum chamber can be varied independently thereby.

5. The apparatus of claim 1 wherein a valve is disposed across said gas supply means upstream of said gas entry opening, said valve functioning in conjunction with said gas rate adjusting means to permit independent variation of said flow rate of said cooling gas with respect to each of said zones of said plenum chamber defined by said first and second baffle means.

6. The apparatus of claim 1 wherein the sides of, respectively, said first and second baffle means are in contact with the side walls of said plenum chamber.

7. The apparatus of claim 1 wherein the plane of said first baffle means, if extended, would intersect said melt extruded filament just below the fiber stick point.

8. The apparatus of claim 1 wherein said first baffle means is positioned such that the length of said gas diverting means extending therefrom in the general direction of said gas entry opening varies from being approximately equal to the length of said gas diverting means extending therefrom in the opposite direction to being four times the length of said gas diverting means extending therefrom in the opposite direction.

9. The apparatus of claim 8, wherein said first baffle means is positioned such that the length of said gas diverting means extending therefrom in the general direction of said gas entry opening is three times the length of said gas diverting means extending therefrom in the opposite direction.

10. Apparatus as defined in claim 2, wherein the cells of said honeycomb sheet are disposed in a plane which is approximately perpendicular to the plane of said diffuser.

11. An apparatus for quenching a melt extruded filament which comprises:

A. a quenching chamber adapted to have said melt extruded filament pass therethrough;

B. a plenum chamber, said plenum chamber being separated from said quenching chamber by a diffuser and comprising:

B-1. a gas entry opening, said gas entry opening being located such that cooling gas entering therethrough must effect a turn in said plenum chamber in order to pass through said diffuser;

B-2. gas diverting means, said gas diverting means being located between said diffuser and said gas entry opening and comprising:

a. a perforated plate;

b. a honeycomb sheet, said honeycomb sheet being mounted on the face of said perforated plate which is closer to said diffuser; and c. means for sandwiching together said perforated plate and said honeycomb sheet;

B-3. first baffle means, said first baffle means extending in a plane from said diffuser to said gas diverting means;

B-4. second baffle means, said second baffle means extending in a plane from the intersection of said first baffle means and said gas diverting means towards said gas entry opening; and B-5. a gas rate adjuster, said gas rate adjuster comprising at least one plate and adjusting means, the plane of said plate approximately coinciding with the plane of said second baffle means, said plate being pivotally connecting along the length of one of its ends to the end of said second baffle means closer to said gas entry opening along its respective length, said plate pivoting in a planar arc and having a length such that said plate is capable of completely shutting off one of said zones when pivoted in either direction, the length of said second baffle means being fixed by the length of said plate, said adjusting means being connected at one end to said plate and passing through said plenum chamber at its other end, movement of said adjusting means causing a corresponding movement of said plate in said planar arc; and C. gas supply means, said gas supply means delivering said cooling gas to said gas entry opening; whereby said cooling gas effects said turn in said plenum chamber and is directed for passage through said diffuser via said gas diverting means, said gas diverting means also functioning to reduce turbulence and to smooth the velocity profile of said cooling gas for passage through said diffuser, and whereby said first and said second baffle means divide said plenum chamber into at least two separate zones to each of which the amount of said cooling gas being supplied is regulated by said gas rate adjuster.

12. The apparatus of claim 11, wherein the number of said plates is two, and the flow rate of said cooling gas with respect to each of said zones of said plenum chamber can be varied independently thereby.

13. The apparatus of claim 11 wherein a valve is disposed across said gas supply means upstream of said gas entry opening, said valve functioning in conjunction with said gas rate adjuster to permit independent variation of said flow rate of said cooling gas with respect to each of said zones of said plenum chamber defined by said first and second baffle means.

14. The apparatus of claim 11, wherein the sides of, respectively, said first and second baffle means are in contact with the side walls of said plenum chamber.

15. The apparatus of claim 11 wherein the plane of said first baffle means, if extended, would intersect said melt extruded filament just below the fiber stick point.

16. The apparatus of claim 11 wherein said first baffle means is positioned such that the length of said gas diverting means extending therefrom in the general direction of said gas entry opening varies from being approximately equal to the length of said gas diverting means extending therefrom in the opposite direction to being four times the length of said gas diverting means extending therefrom in the opposite direction.

17. The apparatus of claim 16 wherein said first baffle means is positioned such that the length of said gas diverting means extending therefrom in the general direction of said gas entry opening is three times the length of said gas diverting means extending therefrom in the opposite direction.

18. An apparatus for quenching a melt extruded filament which comprises:

A. a quenching chamber adapted to have said melt extruded filament pass substantially vertically therethrough;

B. a plenum chamber, said plenum chamber being separated from said quenching chamber by a diffuser substantially vertically therebetween, said plenum chamber comprising:

B-1. a gas entry opening located at the base of said plenum chamber;

B-2. a first perforated plate, said first perforated plate being spaced from and disposed approximately parallel to said diffuser between said diffuser and said gas entry opening;

B-3. gas diverting means, said gas diverting means being located between said first perforated plate and said gas entry opening and being inclined from the vertical to form a diagonal whose ends terminate at the base of said first perforated plate and the intersection of the back wall and the ceiling of said plenum chamber, the sides of said gas diverting means along its length being in contact with the side walls of said plenum chamber, said gas diverting means comprising:

a. a second perforated plate, the open area of said second perforated plate ranging from 10 to 40 percent;

b. a plurality of blocking strips, said blocking strips being spaced on the downstream face of said second perforated plate and having a length corresponding approximately to the width of said second perforated plate, said blocking strips covering approximately 30 to 40 percent of said face so as to decrease said open area of said second perforated plate to between 6 and 28 percent;

c. a plurality of spacing means, said spacing means being interposed between each of said blocking strips on the lengthwise edges of said downstream face of said second perforated plate so as to fixedly space said blocking strips relative to one another;

d. two angle irons, each of said angle irons having a length approximately equal to the length of said second perforated plate and being mounted above the area corresponding to one of said lengthwise edges on said downstream face of said second perforated plate, one of the legs of each of said angle irons projecting approximately perpendicularly downstream from said second perforated plate;

e. a honeycomb sheet, said honeycomb sheet being placed in the tray formed by said angle irons and said second perforated plate, the cells of said honeycomb sheet being disposed in a horizontal plane which is approximately perpendicular to the plane of said first perforated plate; and f. means for sandwiching together said second perforated plate, said blocking strips, said spacing means, said angle irons, and said honeycomb sheet;

B-4. first baffle means, said first baffle means extending in a horizontal plane from the upstream face of said diffuser to said second perforated plate of said gas diverting means, said first baffle means being positioned such that the length of said gas diverting means therebelow varies from being approximately equal to the length of said gas diverting means thereabove to being approximately four times the length of said gas diverting means thereabove, said first baffle means being positioned such that if extended in said horizontal plane, said first baffle means would intersect said melt extruded filament just below the fiber stick point, said first baffle means having its sides in contact with said side walls of said plenum chamber;

B-5. second baffle means, said second baffle means extending downwardly in a vertical plane from said first baffle means at said second perforated plate so as to form approximately a right angle with said first baffle means, said second baffle means having its sides in contact with said side walls of said plenum chamber, said second baffle means in conjunction with said first baffle means functioning to divide said plenum chamber into two separate zones; and B-6. a gas rate adjuster, said gas rate adjuster comprising a plate and adjusting means, the plane of said plate approximately coinciding with the plane of said second baffle means, said plate being pivotally connected along the length of its upper end to the lower end of said second baffle means along its respective length, said plate pivoting in a planar arc the ends of which are defined by said back wall of said plenum chamber in one direction and by said gas diverting means of said plenum chamber in the other direction, the length of said plate being such that said plate completely shuts off one of said zones when pivoted as far as possible in either direction, the length of said second baffle means being fixed by the length of said plate, said adjusting means being connected at one end to said plate and passing through the back wall of said plenum chamber at its other end, movement of said adjusting means causing a corresponding movement of said plate in said planar arc; and C. gas supply means, said gas supply means delivering cooling gas to said plenum chamber at the base thereof between said back wall of said plenum chamber and the lower end of said gas diverting means, said gas supply means having a honeycomb sheet disposed horizontally thereacross just prior to said gas entry opening at the base of said plenum chamber;

whereby said gas rate adjuster in conjunction with said first and second baffle means permits variation of the flow rate of said cooling gas for quenching of said melt extruded filament approximately above and below said fiber stick point, and whereby said gas diverting means turns and directs said cooling gas for passage through said diffuser, said gas diverting means simultaneously functioning to reduce turbulence and to smooth the velocity profile of said cooling gas for passage through said diffuser.

19. Apparatus as defined in claim 18 wherein said diffuser is a porous, multicellular, polymeric foam.

20. Apparatus as defined in claim 18 wherein a valve is disposed across said gas supply means upstream of said honeycomb sheet, said valve functioning in conjunction with said gas rate adjuster to permit independent variation of said flow rate of said cooling gas with respect to each of said zones of said plenum chamber defined by said first and second baffle means.

* * * * *